US012746457B2

(12) United States Patent
Patterson

(10) Patent No.: US 12,746,457 B2
(45) Date of Patent: Sep. 29, 2026

(54) WATERPROOF SQUEEZABLE GAME CONTROLLER

(71) Applicant: Alexander B. Patterson, Brooklyn, NY (US)

(72) Inventor: Alexander B. Patterson, Brooklyn, NY (US)

( * ) Notice: Subject to any disclaimer, the term of this patent is extended or adjusted under 35 U.S.C. 154(b) by 166 days.

(21) Appl. No.: 18/913,834

(22) Filed: Oct. 11, 2024

(65) Prior Publication Data

US 2025/0121276 A1 Apr. 17, 2025

Related U.S. Application Data

(60) Provisional application No. 63/543,906, filed on Oct. 12, 2023.

(51) Int. Cl.
*A63F 9/24* (2006.01)
*A63F 9/00* (2006.01)

(52) U.S. Cl.
CPC ..... *A63F 9/24* (2013.01); *A63F 9/0079* (2013.01); *A63F 2009/2402* (2013.01); *A63F 2009/2442* (2013.01)

(58) Field of Classification Search
CPC ..... A63F 9/24; A63F 9/00
See application file for complete search history.

(56) References Cited

U.S. PATENT DOCUMENTS

2013/0274712 A1* 10/2013 Schecter ..... A61B 34/76 604/100.01

OTHER PUBLICATIONS

"Novel integrative rehabilitation system for the upper extremity: Design and usability evaluation." (Year: 2021).*

* cited by examiner

*Primary Examiner* — Reginald A Renwick
(74) *Attorney, Agent, or Firm* — Rutan & Tucker LLP; Hani Z. Sayed

(57) ABSTRACT

The present invention relates to a game controller comprising a bulb that is designed to be gripped by a single hand. The bulb is covered in a textured surface to enhance grip and control during gameplay. Additionally, the bulb is disposed with a single hole, through which a tube extends to a receiving interface on a processing board. The processing board is equipped with a plurality of receiving interfaces, and a processor is disposed on the board. This game controller design allows for improved ergonomics and user comfort, while providing seamless connectivity and communication between the bulb and the processing board. The controller is designed to be a fun interface that is holdable in a single hand and is adaptable to many use cases. This design allows for the controller to be hosed down after exposure to ejection materials.

20 Claims, 2 Drawing Sheets

WATERPROOF SQUEEZABLE GAME CONTROLLER

PRIORITY

This application claims the benefit of and priority to U.S. Provisional Application, entitled "Waterproof Squeezable Game Controller," filed on Oct. 12, 2023 and having application Ser. No. 63/543,906, the entirety of said application being incorporated herein by reference.

FIELD

The present disclosure relates to interactive gaming. More particularly, the present disclosure relates to a waterproof game controller.

BACKGROUND

Previous approaches to game controllers have typically involved designs that are not specifically optimized for single-handed use. Traditional game controllers often consist of multiple components and buttons that require the use of both hands for operation. These controllers may be bulky and difficult to handle, particularly for individuals with smaller hands or limited dexterity. Additionally, the surfaces of these controllers are often smooth, which can make them slippery and uncomfortable to hold for extended periods of time.

Additional issues arrive when attempting to incorporate controllers within a wet or other environment that exposes various components to materials that require cleanup after use. For example, a controller for a game may require exposure to ejection material that requires clean up after each game. Traditional designs may fail after clean-up processes from exposure to water, which increases costs per game over time.

SUMMARY OF THE DISCLOSURE

Systems and methods for to a waterproof game controller in accordance with embodiments of the disclosure are described herein. In some embodiments, a game controller includes a bulb, wherein the bulb is configured to be gripped by a single hand; covered in a textured surface; and disposed with a single hole; a processing board configured with a plurality of receiving interfaces; a processor disposed on the processing board; and a tube extending out from the single hole to a receiving interface.

In some embodiments, the processing board is further configured with a pressure sensor on each of the receiving interfaces.

In some embodiments the bulb and tube contain a pocket of air.

In some embodiments, squeezing on the bulb generates an amount of air pressure within the bulb and tube.

In some embodiments, the pressure sensor is configured to register the amount of air pressure within the bulb and tube.

In some embodiments, the pressure sensor is further configured to generate a signal in relation to the amount of air pressure registered.

In some embodiments, the signal is passed to a game logic.

In some embodiments, the game logic is executed on the processor.

In some embodiments, the game logic changes game states in response to a signal indicating a predetermined amount of air pressure.

In some embodiments, the change in game state is based on a combined air pressure across all receiving interfaces of the plurality of receiving interfaces.

In some embodiments, the change in game state is based on a largest air pressure level amongst each of the receiving interfaces of the plurality of receiving interfaces.

In some embodiments, the change in game state is based on a specific air pressure level registered across the plurality of receiving interfaces.

In some embodiments, the bulb and tube are configured to be waterproof.

In some embodiments, the bulb has a teardrop shape.

In some embodiments, the bulb has a circular shape.

In some embodiments, the bulb has a cylindrical shape.

In some embodiments, the bulb has a smooth surface.

In some embodiments, the bulb is configured to be gripped by two or more hands.

In some embodiments, the processing board includes a single receiving interface.

In some embodiments, the game controller further includes a communication port configured to communicate with a game logic.

Other objects, advantages, novel features, and further scope of applicability of the present disclosure will be set forth in part in the detailed description to follow, and in part will become apparent to those skilled in the art upon examination of the following or may be learned by practice of the disclosure. Although the description above contains many specificities, these should not be construed as limiting the scope of the disclosure but as merely providing illustrations of some of the presently preferred embodiments of the disclosure. As such, various other embodiments are possible within its scope. Accordingly, the scope of the disclosure should be determined not by the embodiments illustrated, but by the appended claims and their equivalents.

BRIEF DESCRIPTION OF DRAWINGS

The above, and other, aspects, features, and advantages of several embodiments of the present disclosure will be more apparent from the following description as presented in conjunction with the following several figures of the drawings.

Figure 1:
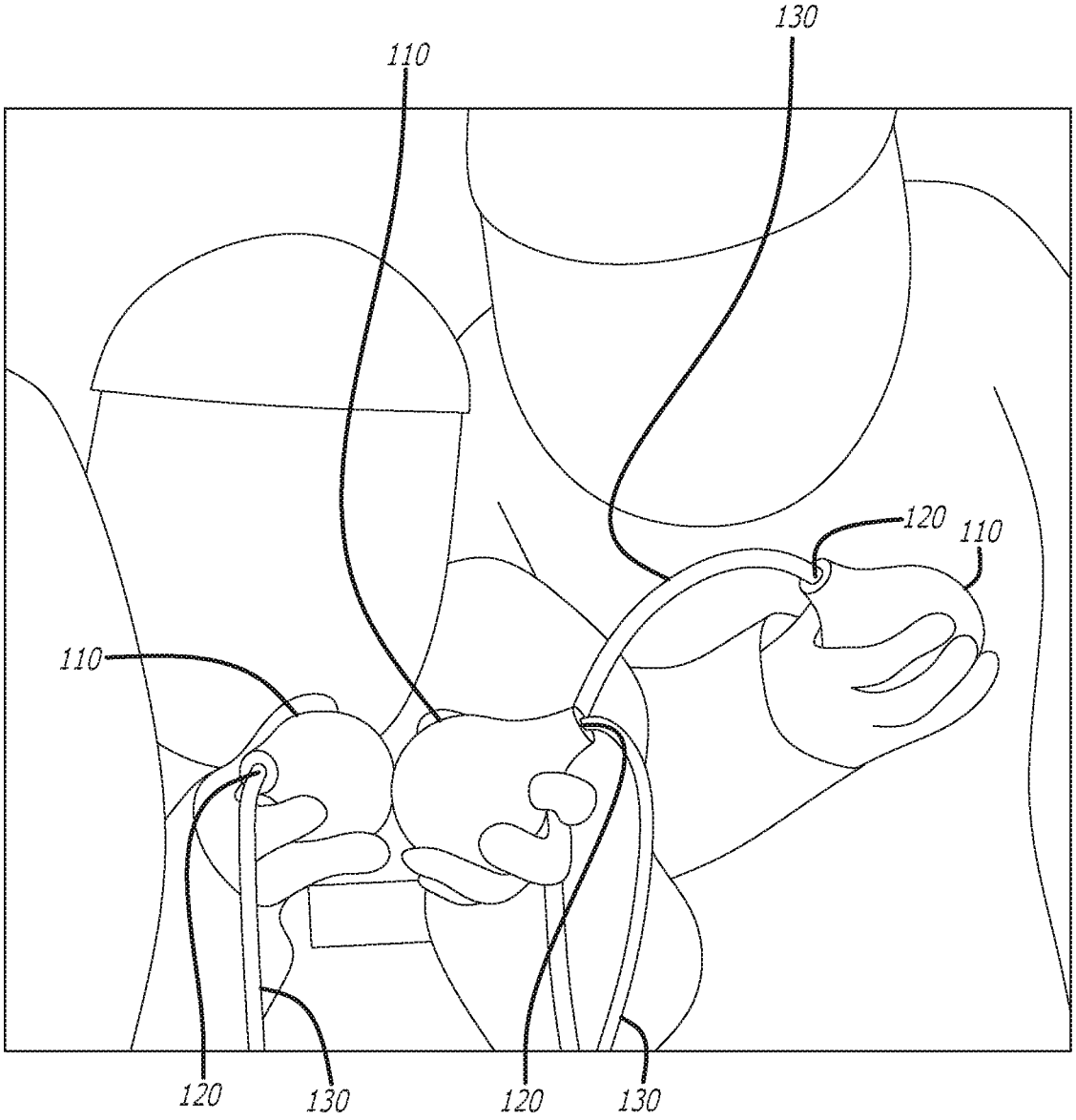
FIG. 1 is an example of a waterproof game controller being utilized during a game in accordance with various embodiments of the disclosure.

Corresponding reference characters indicate corresponding components throughout the several figures of the drawings. Elements in the several figures are illustrated for simplicity and clarity and have not necessarily been drawn to scale. For example, the dimensions of some of the elements in the figures might be emphasized relative to other elements for facilitating understanding of the various presently disclosed embodiments. In addition, common, but well-understood, elements that are useful or necessary in a commercially feasible embodiment are often not depicted in order to facilitate a less obstructed view of these various embodiments of the present disclosure.

DETAILED DESCRIPTION

In response to the issues described above, devices and methods are discussed herein that provide a waterproof game controller that can be held in a single hand and be cleaned multiple times with water. In various embodiments described herein, a waterproof controller can be configured to be held in a single hand and is fun to use during a game. With this design, the controller is able to survive being hit with ejection materials such as paint and/or foam and be subsequently hosed down afterward.

In many embodiments, the game controller includes a bulb that is squeezable and has a tube at one end that is connected to a processing board with a plurality of receiving interfaces. The processor board can have a processor configured to operate a game logic or be in communication with a game logic. The controller can have a tube extending out from the single hole to interface with a receiving interface.

In various embodiments, the game controller can have an amount or pocket of air within the bulb and tube that is connected to a pressure sensor disposed on or in association with the receiving interface. The pressure sensor can generate a signal that can be calibrated to correlate with an amount of squeezing being done by a player during a game.

This signal can be passed to a game logic which can register it as a press or level. This may cause a change in game state. In some embodiments, the bulb may have various shapes, such as, but not limited to, a bulb, a teardrop, a circle, a cylinder. In more embodiments, the texture of the bulb may be textured for better grip, or it may be smooth depending on the material used.

We were looking for a solution for a button that could be held in 1 hand, and which could act as a "key press" in a game, such as, a Unity game (game software), but which could withstand the harsh environment of the Beat The Bomb's bomb room for technology, especially if that tech is literally in the hands of customers who are on the receiving end of the paint blast and splatter, and more recently foam soap, and slime goo, and then being hosed down with water afterwards. We were also looking for a unique interface that would be different from other more conventional controllers that customers would be used to, and that could be really fun and remind you of a kid squeezing a rubber ducky bath toy. Ideally if the controller could also give a range of input levels, versus just a binary on/off pushed/not pushed, that would be great as well. The Waterproof Squeezable Game Controller achieves all of those ends. They are made by taking enema bulbs, connecting a tube to them, and then sending that tube into an air pressure sensor, hooked up to a microprocessor, such as, but not limited to, an Arduino. We've had to make continued modifications including a method to make sure the bulb stays onto the tube.

Aspects of the present disclosure may be embodied as an apparatus, system, method, or computer program product. Accordingly, aspects of the present disclosure may take the form of an entirely hardware embodiment, an entirely software embodiment (including firmware, resident software, micro-code, or the like) or an embodiment combining software and hardware aspects that may all generally be referred to herein as a "function," "module," "apparatus," or "system." Furthermore, aspects of the present disclosure may take the form of a computer program product embodied in one or more non-transitory computer-readable storage media storing computer-readable and/or executable program code. Many of the functional units described in this specification have been labeled as functions, in order to emphasize their implementation independence more particularly. For example, a function may be implemented as a hardware circuit comprising custom VLSI circuits or gate arrays, off-the-shelf semiconductors such as logic chips, transistors, or other discrete components. A function may also be implemented in programmable hardware devices such as via field programmable gate arrays, programmable array logic, programmable logic devices, or the like.

Functions may also be implemented at least partially in software for execution by various types of processors. An identified function of executable code may, for instance, comprise one or more physical or logical blocks of computer instructions that may, for instance, be organized as an object, procedure, or function. Nevertheless, the executables of an identified function need not be physically located together but may comprise disparate instructions stored in different locations which, when joined logically together, comprise the function and achieve the stated purpose for the function.

Indeed, a function of executable code may include a single instruction, or many instructions, and may even be distributed over several different code segments, among different programs, across several storage devices, or the like. Where a function or portions of a function are implemented in software, the software portions may be stored on one or more computer-readable and/or executable storage media. Any combination of one or more computer-readable storage media may be utilized. A computer-readable storage medium may include, for example, but not limited to, an electronic, magnetic, optical, electromagnetic, infrared, or semiconductor system, apparatus, or device, or any suitable combination of the foregoing, but would not include propagating signals. In the context of this document, a computer readable and/or executable storage medium may be any tangible and/or non-transitory medium that may contain or store a program for use by or in connection with an instruction execution system, apparatus, processor, or device.

Computer program code for carrying out operations for aspects of the present disclosure may be written in any combination of one or more programming languages, including an object-oriented programming language such as Python, Java, Smalltalk, C++, C#, Objective C, or the like, conventional procedural programming languages, such as the "C" programming language, scripting programming languages, and/or other similar programming languages. The program code may execute partly or entirely on one or more of a user's computer and/or on a remote computer or server over a data network or the like.

A component, as used herein, comprises a tangible, physical, non-transitory device. For example, a component may be implemented as a hardware logic circuit comprising custom VLSI circuits, gate arrays, or other integrated circuits; off-the-shelf semiconductors such as logic chips, transistors, or other discrete devices; and/or other mechanical or electrical devices. A component may also be implemented in programmable hardware devices such as field programmable gate arrays, programmable array logic, programmable logic devices, or the like. A component may comprise one or more silicon integrated circuit devices (e.g., chips, die, die planes, packages) or other discrete electrical devices, in electrical communication with one or more other components through electrical lines of a printed circuit board (PCB) or the like. Each of the functions and/or modules described herein, in certain embodiments, may alternatively be embodied by or implemented as a component.

A circuit, as used herein, comprises a set of one or more electrical and/or electronic components providing one or more pathways for electrical current. In certain embodiments, a circuit may include a return pathway for electrical current, so that the circuit is a closed loop. In another embodiment, however, a set of components that does not include a return pathway for electrical current may be referred to as a circuit (e.g., an open loop). For example, an integrated circuit may be referred to as a circuit regardless of whether the integrated circuit is coupled to ground (as a return pathway for electrical current) or not. In various embodiments, a circuit may include a portion of an integrated circuit, an integrated circuit, a set of integrated circuits, a set of non-integrated electrical and/or electrical components with or without integrated circuit devices, or the like. In one embodiment, a circuit may include custom VLSI circuits, gate arrays, logic circuits, or other integrated circuits; off-the-shelf semiconductors such as logic chips, transistors, or other discrete devices; and/or other mechanical or electrical devices. A circuit may also be implemented as a synthesized circuit in a programmable hardware device such as field programmable gate array, programmable array logic, programmable logic device, or the like (e.g., as firmware, a netlist, or the like). A circuit may comprise one or more silicon integrated circuit devices (e.g., chips, die, die planes, packages) or other discrete electrical devices, in electrical communication with one or more other components through electrical lines of a printed circuit board (PCB) or the like. Each of the functions and/or modules described herein, in certain embodiments, may be embodied by or implemented as a circuit.

Reference throughout this specification to "one embodiment," "an embodiment," or similar language means that a particular feature, structure, or characteristic described in connection with the embodiment is included in at least one embodiment of the present disclosure. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to", unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Further, as used herein, reference to reading, writing, storing, buffering, and/or transferring data can include the entirety of the data, a portion of the data, a set of the data, and/or a subset of the data. Likewise, reference to reading, writing, storing, buffering, and/or transferring non-host data can include the entirety of the non-host data, a portion of the non-host data, a set of the non-host data, and/or a subset of the non-host data.

Lastly, the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps, or acts are in some way inherently mutually exclusive.

Aspects of the present disclosure are described below with reference to schematic flowchart diagrams and/or schematic block diagrams of methods, apparatuses, systems, and computer program products according to embodiments of the disclosure. It will be understood that each block of the schematic flowchart diagrams and/or schematic block diagrams, and combinations of blocks in the schematic flowchart diagrams and/or schematic block diagrams, can be implemented by computer program instructions. These computer program instructions may be provided to a processor of a computer or other programmable data processing apparatus to produce a machine, such that the instructions, which execute via the processor or other programmable data processing apparatus, create means for implementing the functions and/or acts specified in the schematic flowchart diagrams and/or schematic block diagrams block or blocks.

It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated figures. Although various arrow types and line types may be employed in the flowchart and/or block diagrams, they are understood not to limit the scope of the corresponding embodiments. For instance, an arrow may indicate a waiting or monitoring period of unspecified duration between enumerated steps of the depicted embodiment.

In the following detailed description, reference is made to the accompanying drawings, which form a part thereof. The foregoing summary is illustrative only and is not intended to be in any way limiting. In addition to the illustrative aspects, embodiments, and features described above, further aspects, embodiments, and features will become apparent by reference to the drawings and the following detailed description. The description of elements in each figure may refer to elements of proceeding figures. Like numbers may refer to like elements in the figures, including alternate embodiments of like elements.

Referring to FIG. 1, an example of a waterproof game controller being utilized during a game in accordance with various embodiments of the disclosure is shown. In many embodiments, the waterproof game controller can comprise a bulb 110 which can be textured for handline and/or be configured to be held in a single hand. The bulb 110 may further comprise a single hole 120 which can interface with a tube 130 that can be tubing that goes to a processing board interface.

As discussed above the bulb 110, and tube 130 can be designed to be waterproof such that ejection material can be washed off of it via water. To facilitate this further, the tube 130 can interface with the single hole 120 in a waterproof fashion. The tube 120 and bulb 110 can be configured with a pocket of air, such that squeezing the bulb 110 can create an increase in air pressure which can travel through the tube 130 to a pressure sensor on a processing board or other receiving interface or device.

Although a specific embodiment for a waterproof game controller being utilized during a game suitable for carrying out the various steps, processes, methods, and operations described herein is discussed with respect to FIG. 1, any of a variety of systems and/or processes may be utilized in accordance with embodiments of the disclosure. For example, the game controller may be smaller as required such that air pressure can be generated on a pressure sensor. The elements depicted in FIG. 1 may also be interchangeable with other elements of FIG. 2 as required to realize a particularly desired embodiment.

Figure 2:
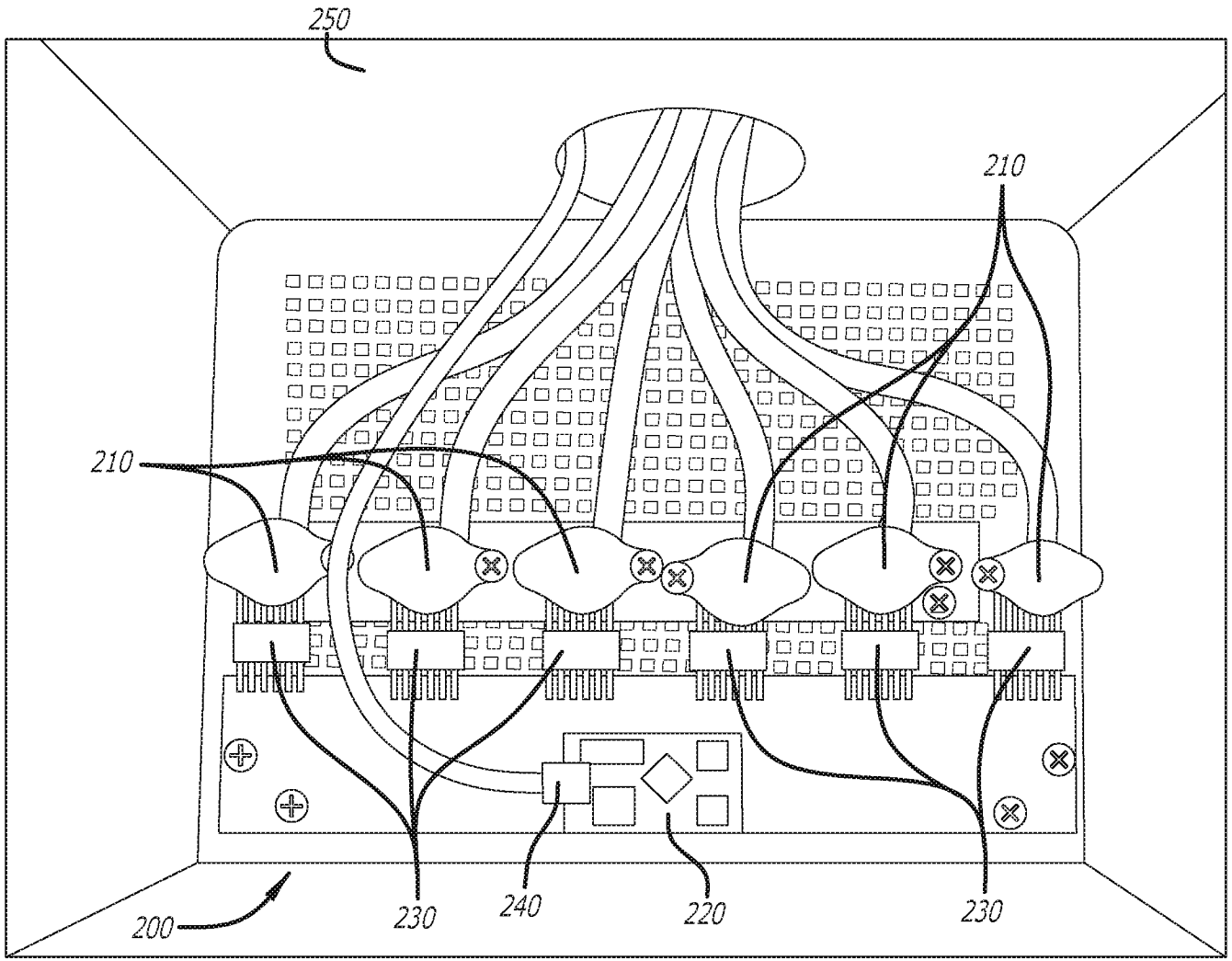
FIG. 2 is an example of a processing board with a plurality of receiving interfaces in accordance with various embodiments of the disclosure.

Referring to FIG. 2, an example of a processing board 200 with a plurality of receiving interfaces 210 in accordance with various embodiments of the disclosure is shown. In some embodiments, the processing board 200 can have a processor 220 that can coordinate, receive, or otherwise process signals from sensors, such as pressure sensors that can be configured on various receiving interfaces 210. In further embodiments, the processor 220 may be communicatively coupled with a network interface controller, such as an ethernet port 240 as depicted in the embodiment shown in FIG. 2.

In still more embodiments, the processing board 200 can be enclosed within a safety enclosure 250. The safety enclosure 250 can protect the processing board 200 from a variety of environmental hazards within the game room. In various embodiments, the safety enclosure 250 can itself be waterproof such that water or other ejection materials cannot enter and damage various components.

Although a specific embodiment for a processing board with a plurality of receiving interfaces suitable for carrying out the various steps, processes, methods, and operations described herein is discussed with respect to FIG. 2, any of a variety of systems and/or processes may be utilized in accordance with embodiments of the disclosure. For example, the processing board may be deployed within the bulb of the waterproof controller and communicate wirelessly with a game logic. The elements depicted in FIG. 2 may also be interchangeable with other elements of FIG. 1 as required to realize a particularly desired embodiment.

Information Although the present disclosure has been described in certain specific aspects, many additional modifications and variations would be apparent to those skilled in the art. In particular, any of the various processes described above can be performed in alternative sequences and/or in parallel (on the same or on different computing devices) in order to achieve similar results in a manner that is more appropriate to the requirements of a specific application. It is therefore to be understood that the present disclosure can be practiced other than specifically described without departing from the scope and spirit of the present disclosure. Thus, embodiments of the present disclosure should be considered in all respects as illustrative and not restrictive. It will be evident to the person skilled in the art to freely combine several or all of the embodiments discussed here as deemed suitable for a specific application of the disclosure. Throughout this disclosure, terms like "advantageous", "exemplary" or "example" indicate elements or dimensions which are particularly suitable (but not essential) to the disclosure or an embodiment thereof and may be modified wherever deemed suitable by the skilled person, except where expressly required. Accordingly, the scope of the disclosure should be determined not by the embodiments illustrated, but by the appended claims and their equivalents.

Any reference to an element being made in the singular is not intended to mean "one and only one" unless explicitly so stated, but rather "one or more." All structural and functional equivalents to the elements of the above-described preferred embodiment and additional embodiments as regarded by those of ordinary skill in the art are hereby expressly incorporated by reference and are intended to be encompassed by the present claims.

Moreover, no requirement exists for a system or method to address each and every problem sought to be resolved by the present disclosure, for solutions to such problems to be encompassed by the present claims. Furthermore, no element, component, or method step in the present disclosure is intended to be dedicated to the public regardless of whether the element, component, or method step is explicitly recited in the claims. Various changes and modifications in form, material, workpiece, and fabrication material detail can be made, without departing from the spirit and scope of the present disclosure, as set forth in the appended claims, as might be apparent to those of ordinary skill in the art, are also encompassed by the present disclosure.

Clause 1. A game controller, comprising: a bulb, wherein the bulb is: configured to be gripped by a single hand; covered in a textured surface; and disposed with a single hole; a processing board configured with a plurality of receiving interfaces; a processor disposed on the processing board; and a tube extending out from the single hole to a receiving interface.

Clause 2. The game controller of clause 1, wherein the processing board is further configured with a pressure sensor on each of the receiving interfaces.

Clause 3. The game controller of clause 2, wherein the bulb and tube contain a pocket of air.

Clause 4. The game controller of clause 3, wherein squeezing on the bulb generates an amount of air pressure within the bulb and tube.

Clause 5. The game controller of clause 4, wherein the pressure sensor is configured to register the amount of air pressure within the bulb and tube.

Clause 6. The game controller of clause 5, wherein the pressure sensor is further configured to generate a signal in relation to the amount of air pressure registered.

Clause 7. The game controller of clause 6, wherein the signal is passed to a game logic.

Clause 8. The game controller of clause 7, wherein the game logic is executed on the processor.

Clause 9. The game controller of clause 7, wherein the game logic changes game states in response to a signal indicating a predetermined amount of air pressure.

Clause 10. The game controller of clause 9, wherein the change in game state is based on a combined air pressure across all receiving interfaces of the plurality of receiving interfaces.

Clause 11. The game controller of clause 9, wherein the change in game state is based on a largest air pressure level amongst each of the receiving interfaces of the plurality of receiving interfaces.

Clause 12. The game controller of clause 9, wherein the change in game state is based on a specific air pressure level registered across the plurality of receiving interfaces.

Clause 13. The game controller of clause 1, wherein the bulb and tube are configured to be waterproof.

Clause 14. The game controller of clause 1, wherein the bulb has a teardrop shape.

Clause 15. The game controller of clause 1, wherein the bulb has a circular shape.

Clause 16. The game controller of clause 1, wherein the bulb has a cylindrical shape.

Clause 17. The game controller of clause 1, wherein the bulb has a smooth surface.

Clause 18. The game controller of clause 1, wherein the bulb is configured to be gripped by two or more hands.

Clause 19. The game controller of clause 1, wherein the processing board comprises a single receiving interface.

Clause 20. The game controller of clause 1, wherein the game controller further comprises a communication port configured to communicate with a game logic.

What is claimed is:

1. A game controller, comprising:

a bulb, wherein the bulb is:

configured to be gripped by a single hand;

covered in a textured surface; and disposed with a single hole;

a processing board configured with a plurality of receiving interfaces;

a processor disposed on the processing board; and a tube extending out from the single hole to a receiving interface.

2. The game controller of claim 1, wherein the processing board is further configured with a pressure sensor on each of the receiving interfaces.

3. The game controller of claim 2, wherein the bulb and tube contain a pocket of air.

4. The game controller of claim 3, wherein squeezing on the bulb generates an amount of air pressure within the bulb and tube.

5. The game controller of claim 4, wherein the pressure sensor is configured to register the amount of air pressure within the bulb and tube.

6. The game controller of claim 5, wherein the pressure sensor is further configured to generate a signal in relation to the amount of air pressure registered.

7. The game controller of claim 6, wherein the signal is passed to a game logic.

8. The game controller of claim 7, wherein the game logic is executed on the processor.

9. The game controller of claim 7, wherein the game logic changes game states in response to a signal indicating a predetermined amount of air pressure.

10. The game controller of claim 9, wherein the change in game state is based on a combined air pressure across all receiving interfaces of the plurality of receiving interfaces.

11. The game controller of claim 9, wherein the change in game state is based on a largest air pressure level amongst each of the receiving interfaces of the plurality of receiving interfaces.

12. The game controller of claim 9, wherein the change in game state is based on a specific air pressure level registered across the plurality of receiving interfaces.

13. The game controller of claim 1, wherein the bulb and tube are configured to be waterproof.

14. The game controller of claim 1, wherein the bulb has a teardrop shape.

15. The game controller of claim 1, wherein the bulb has a circular shape.

16. The game controller of claim 1, wherein the bulb has a cylindrical shape.

17. The game controller of claim 1, wherein the bulb has a smooth surface.

18. The game controller of claim 1, wherein the bulb is configured to be gripped by two or more hands.

19. The game controller of claim 1, wherein the processing board comprises a single receiving interface.

20. The game controller of claim 1, wherein the game controller further comprises a communication port configured to communicate with a game logic.

* * * * *